US006488483B1

(12) United States Patent
Hsieh

(10) Patent No.: US 6,488,483 B1
(45) Date of Patent: Dec. 3, 2002

(54) LOW POWER LOSS HEAT DISSIPATION FAN

(76) Inventor: Hsin-Mao Hsieh, No. 6, East Section, Chiao Nan Li, Industrial 6th Rd., Pingtung City, Pingtung Hsien (TW)

( * ) Notice: Subject to any disclaimer, the term of this patent is extended or adjusted under 35 U.S.C. 154(b) by 0 days.

(21) Appl. No.: 09/879,945

(22) Filed: Jun. 14, 2001

(51) Int. Cl.[7] ..... F04B 17/00; F04B 35/04
(52) U.S. Cl. ..... 417/354; 417/423.12
(58) Field of Search ..... 417/354, 423.1, 417/423.12; 310/60 R, 191, 263, 67 R; 361/697

(56) References Cited

U.S. PATENT DOCUMENTS 3,644,066 A * 2/1972 Heob et al. ..... 417/354
3,648,090 A * 3/1972 Voin ..... 310/191
3,961,864 A * 6/1976 Papst et al. ..... 417/354
4,584,496 A * 4/1986 Frister ..... 310/60 R
4,882,515 A * 11/1989 Radomaski ..... 310/263
4,955,791 A * 9/1990 Wrobel ..... 417/354
RE34,268 E * 6/1993 Muller ..... 310/67 R
6,267,567 B1 * 7/2001 Hsieh ..... 417/354
6,304,446 B1 * 10/2001 Hsieh ..... 361/697
6,315,529 B1 * 11/2001 Hu ..... 417/423.1
6,318,976 B1 * 11/2001 Hsieh ..... 417/423.12
6,416,300 B1 * 7/2002 Tang et al. ..... 417/423.12

* cited by examiner

*Primary Examiner*—Joseph Pelham
*Assistant Examiner*—Leonid Fastovsky
(74) *Attorney, Agent, or Firm*—Rabin & Berdo, P.C.

(57) ABSTRACT

A heat dissipation fan that has a casing, a stator and a fan. The stator is pressed onto a sleeve secured in the casing. The stator has a coil and two pole disks respectively abutting opposite sides of the coil. A low-friction member is mounted in the sleeve. The fan is rotatably mounted in and around the stator inside the casing. A permanent magnet is mounted in the fan to make the fan a rotor. A shaft securely attached to the fan extends from the fan and passes through the low-friction member. The permanent magnet has an axial height shorter than that of the coil of the stator. The permanent magnet has a horizontal central line axially displaced from a horizontal central line of the coil of the stator. Accordingly, the fan with the shaft will not move axially during the operation of the heat dissipation fan. Power loss will be avoided.

5 Claims, 4 Drawing Sheets

LOW POWER LOSS HEAT DISSIPATION FAN

BACKGROUND OF THE INVENTION

1. Field of the Invention

The present invention relates to a heat dissipation fan, and more particularly to a heat dissipation fan with low power loss.

2. Description of Related Art

With reference to FIG. 4, a conventional heat dissipation fan in accordance with the prior art comprises a casing (40), a stator (50) and a fan (60). The combination of the stator (40) and the fan (60) constitute a motor with the fan (60) serving as a rotor for the motor. The casing includes a sleeve (54) secured in the casing (40). The stator (50) is pressed onto the sleeve (54). The stator (50) has a coil (53), two pole disks (51,52) and a circuit board (55). The coil (53) has two sides, and the two pole disks (51, 52) respectively abut opposite sides of the coil (53). The circuit board (55) is securely attached to the stator (50) and is electrically connected to the coil (53).

The fan (60) is rotatably mounted in the stator (50) inside the casing (40). A permanent magnet (63) is securely mounted in the fan (60) to make the fan (60) the motor rotor. The fan (60) rotates due to the interaction between the magnetic forces in stator (50) and the permanent magnet (63). A low-friction member (541) like a lubricating bushing or a ball bearing is pressed into the sleeve (54). A shaft (64) securely attached to the fan (60) extends from the fan (60) and passes through a passage (not numbered) defined axially through the low-friction member (541). A neck (not numbered) is defined near the free end of the shaft (64). A locking disk (542) is mounted in the neck to securely hold the shaft (64) in the low-friction member (541).

Because there is a gap defined between the low-friction member (541) and the locking disk (542) and another gap defined between the low-friction member (541) and the fan (60), the shaft (64) will move up and down in the passage in the low-friction member (541) when the heat dissipation fan is in operation. The axial movement of the shaft (64) in the passage causes power loss in the fan motor.

To overcome the shortcomings, the present invention provides an improved heat dissipation fan to mitigate or obviate the aforementioned problems.

SUMMARY OF THE INVENTION

The main objective of the invention is to provide an improved heat dissipation fan that has low power loss. The heat dissipation fan has a casing, a stator and a fan. The combination of the stator and the fan constitutes a motor with the fan serving as a rotor for the motor. The casing includes a sleeve secured in the casing. The stator is pressed onto the sleeve inside the casing. The stator has a coil, two pole disks and a circuit board. The two pole disks respectively abut opposite sides of the coil. A low-friction member is mounted in the sleeve. The fan is rotatably mounted in the stator inside the casing. A permanent magnet is securely mounted in the fan to make the fan the motor rotor. A shaft securely attached to the fan extends from the fan and passes through the low-friction member. The permanent magnet and the coil in the stator have fixed heights. The height of the permanent magnet is smaller than that of the coil. The permanent magnet has a horizontal central line displaced axially from a horizontal central line of the coil of the stator.

With such an arrangement, the fan will not move relative to the low-friction member due to the magnetic attraction provided by the coil on the permanent magnet. The fan with the shaft will not move axially during the operation of the heat dissipation fan. Consequently there is no power loss due to axial movement of the shaft in the low-friction member.

Other objects, advantages and novel features of the invention will become more apparent from the following detailed description when taken in conjunction with the accompanying drawings.

DETAILED DESCRIPTION OF PREFERRED EMBODIMENT

Figure 1:
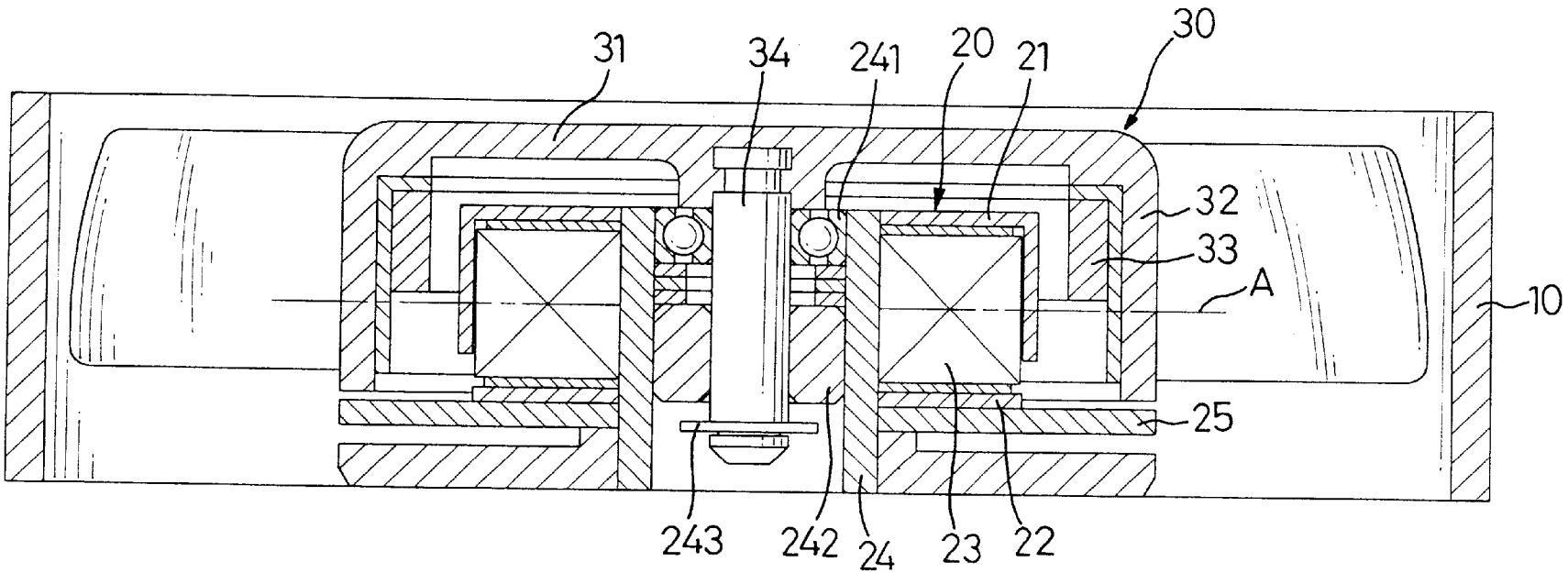
FIG. 1 is side plan view in partial section of a first embodiment of a heat dissipation fan in accordance with the present invention.

With reference to FIG. 1, a heat dissipation fan in accordance with the present invention comprises a casing (10), a stator (20) and a fan (30). The combination of the stator (20) and the fan (30) constitute a motor with the fan (30) serving as a rotor for the motor. The casing (10) includes a sleeve (24) securely mounted in the casing (10). The stator (20) is pressed onto the sleeve (24) inside the casing (10). The stator (20) comprises a coil (23), two pole disks (21,22) and a circuit board (25). The coil (23) has two sides, and the two pole disks (21,22) respectively abut opposite sides of the coil (23). The circuit board (25) is attached to the stator (20) and is electrically connected to the coil (23).

A low-friction member (not numbered) is securely mounted in the sleeve (21). The low-friction member can be a lubricating bushing containing lubricant, a bearing or a combination of friction reducing elements. With reference to FIG. 1, one embodiment of the low-friction member comprises a lubricating bushing (242), a ball bearing (241) and multiple gaskets (not numbered) arranged between the busing (242) and the ball bearing (241). A passage (not numbered) is defined axially through the low-friction member.

The fan (30) is rotatably mounted in the stator (20) inside the casing (10). The fan has a central radial base (31) with an outer edge (not numbered), and a skirt (32) is defined around and extends axially from the outer edge of the base (31). The skirt (32) has an outer periphery and an inner periphery. Multiple blades (not numbered) are arranged on the outer periphery of the skirt (32) of the fan (40). A permanent magnet (33) is mounted on the inner periphery of the skirt (32) of the fan (30) to make the fan the motor rotor. The permanent magnet (33) has an axial height shorter than that of the coil (23) of the stator (20). The permanent magnet (33) has a horizontal central line displaced axially from a horizontal central line (A) of the coil (23). In practice, the permanent magnet (33) is secured in the skirt (32) and near the base (31).

A shaft (34) securely attached to the fan (30) extends from the fan (30) and passes through the passage in the low-friction member mounted in the sleeve (24). A neck (not numbered) is defined near the free end of the shaft (34), and a locking disk (243) with a central hole securely engages the neck of the shaft (34) to securely hold the shaft (34) in the passage in the low-friction member.

During the operation of the dissipation fan, the fan (30) will move relative to the low-friction member until the base (31) of the fan (30) abuts the low-friction member due to the magnetic attraction provided by the coil (23) on the permanent magnet (33). Consequently, the horizontal position of the fan (30) will be held by means of the magnetic attraction provided by the coil (23) on the permanent magnet (33). The fan (30) with the shaft (34) will not move axially during the operation of the heat dissipation fan even when a gap is defined between the locking disk (243) and the low-friction member. An axial vibration of the shaft (34) will not occur, the rotation of the fan (30) becomes smoother and power will not be lost.

Figure 2:
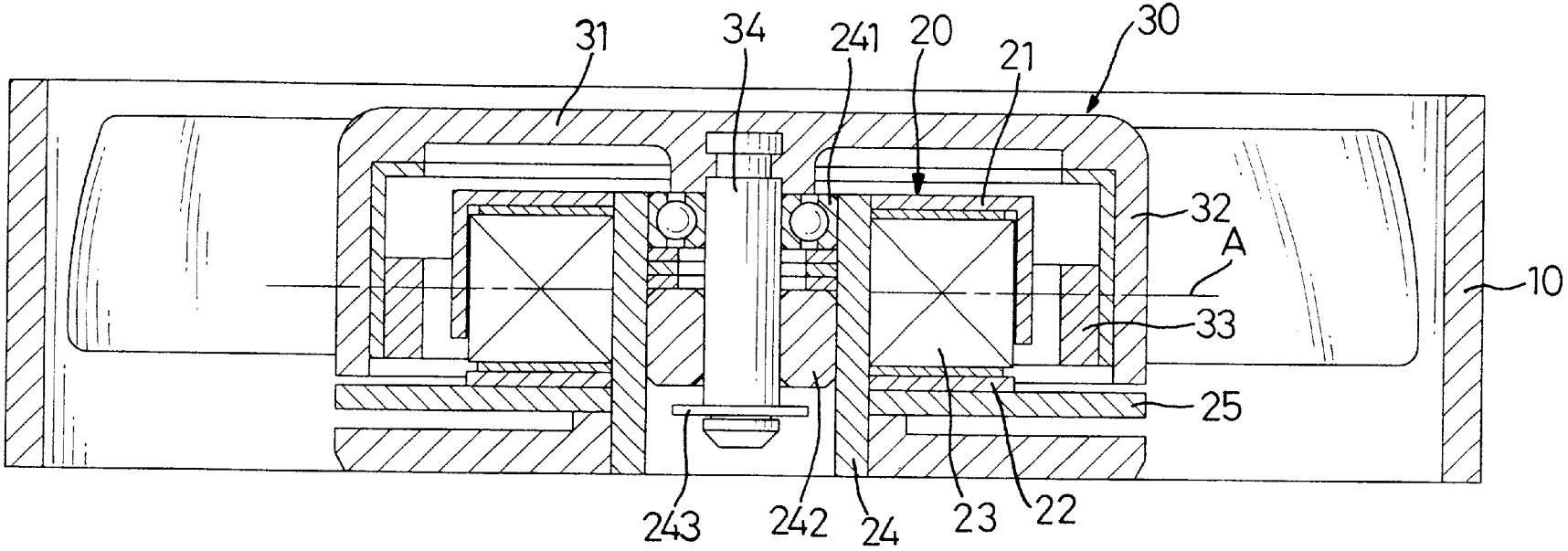
FIG. 2 is a side plan view in partial section of a second embodiment of a heat dissipation fan in accordance with the present invention.
Figure 3:
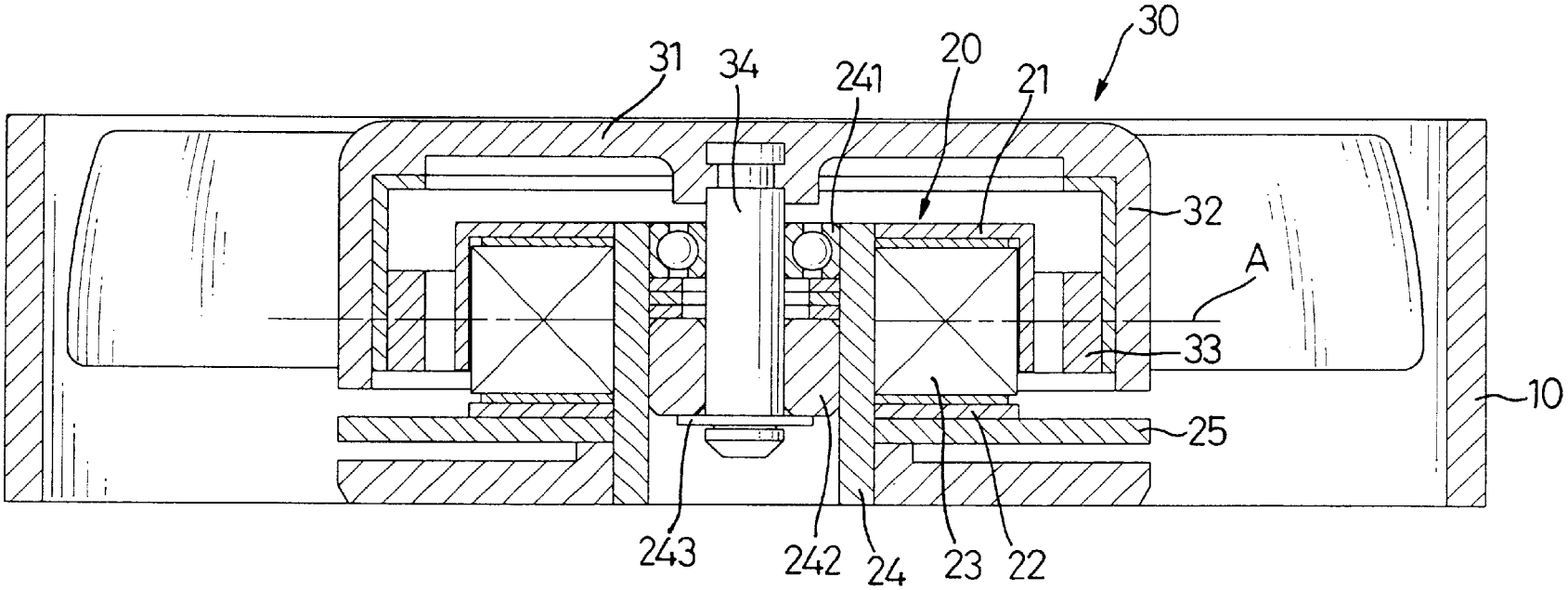
FIG. 3 is an operational side plan view in partial section of the heat dissipation fan in FIG. 2.
Figure 4:
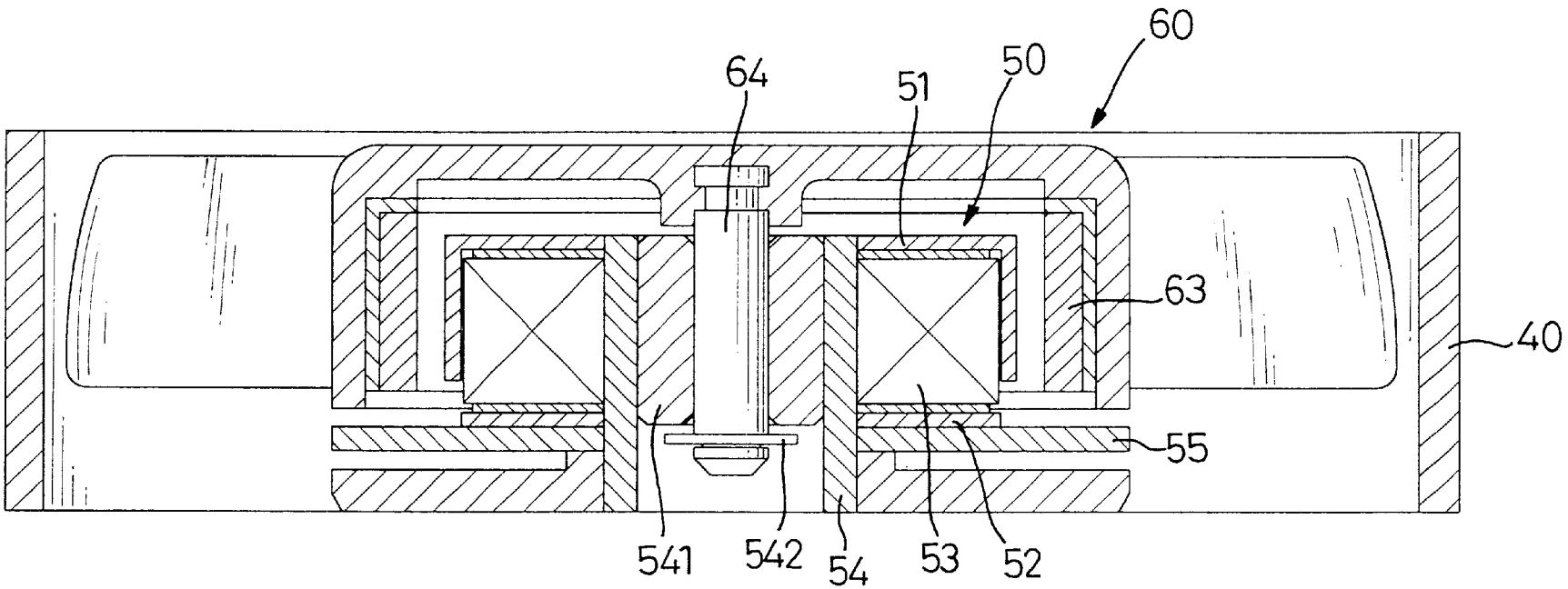
FIG. 4 PRIOR ART
FIG. 4 is a side plan view in partial section of a conventional heat dissipation fan in accordance with the prior art.

With reference to FIGS. 2 and 3, in a second embodiment, the permanent magnet (33) is mounted in the skirt (32) away from the base (31). When the dissipation fan is switched on, the fan (30) will move relative to the low-friction member until the locking disk (243) abuts the low-friction member due the magnetic attraction provided by the coil (23) on the permanent magnet (33). The fan (30) and the shaft (34) will not move axially during the operation of the heat dissipation fan even when there is a gap defined between the base (31) of the fan (30) and the low-friction member.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat dissipation fan comprising:

a casing;

a sleeve secured in the casing;

a stator pressed onto the sleeve and having a coil with two sides and two pole disks respectively abutting opposite sides of the coil;

a low-friction member mounted in the sleeve and having a passage defined through the low-friction member;

a fan rotatably mounted around the stator inside the casing;

a permanent magnet mounted in the fan to make the fan a rotor;

a shaft securely attached to the fan extending from the fan and passing through the passage in the low-friction member; and a locking disk securely mounted on a free end of the shaft to lock the shaft in the low-friction member, wherein the permanent magnet has an axial height shorter than that of the coil of the stator; and the permanent magnet has a horizontal central line axially displaced from a horizontal central line of the coil of the stator.

2. The dissipation fan as claimed in claim 1, wherein the fan comprises:

a base;

a skirt with an inner and outer periphery defined around the base on which the permanent magnet is securely mounted on the inner periphery; and multiple blades attached to or formed on an outer periphery of the skirt.

3. The dissipation fan as claimed in claim 2, wherein the permanent magnet is attached to the inner periphery of the skirt near the base.

4. The dissipation fan as claimed in claim 2, wherein the permanent magnet is attached to the inner periphery of the skirt away from the base.

5. The dissipation fan as claimed in claim 1, wherein the low-friction member comprises a lubricating bushing pressed into the sleeve, a ball bearing pressed into the sleeve and multiple gaskets arranged between the bushing and the ball bearing.

* * * * *